United States Patent [19]

Burke

[11] Patent Number: 4,784,068

[45] Date of Patent: Nov. 15, 1988

[54] SEGMENTED SLIDING SILL WEAR PLATE

[75] Inventor: Michael K. Burke, Wheaton, Ill.

[73] Assignee: Zeftek, Inc., Batavia, Ill.

[21] Appl. No.: 77,682

[22] Filed: Jul. 24, 1987

[51] Int. Cl.[4] ..... B61F 1/02

[52] U.S. Cl. ..... 105/418; 105/392.5; 384/42

[58] Field of Search ..... 384/9, 42; 105/392.5, 105/416, 418; 213/1 A, 10, 31, 35, 51

[56] References Cited

U.S. PATENT DOCUMENTS

| | | | |
|---|---|---|---|
| 2,378,343 | 6/1945 | Walter | 384/9 |
| 2,763,380 | 9/1956 | Danielson . | |
| 3,054,645 | 9/1962 | Evans | 384/42 |
| 3,286,659 | 11/1966 | Cunningham . | |
| 4,079,818 | 3/1978 | Chierici . | |
| 4,188,888 | 2/1980 | Cooper et al. . | |
| 4,237,792 | 12/1980 | Somers . | |
| 4,237,793 | 12/1980 | Holden . | |
| 4,238,039 | 12/1980 | Cooper et al. . | |
| 4,239,007 | 12/1980 | Kleykamp et al. . | |
| 4,249,665 | 2/1981 | Kleykamp . | |
| 4,261,472 | 4/1981 | Moore et al. . | |
| 4,264,015 | 4/1981 | Mathieu . | |
| 4,289,077 | 9/1981 | Kleykamp et al. . | |
| 4,348,964 | 9/1982 | Randolph . | |
| 4,440,095 | 4/1984 | Mathieu | 384/42 |
| 4,452,345 | 6/1984 | Mathieu . | |

*Primary Examiner*—Stephen Hepperle
*Attorney, Agent, or Firm*—Lloyd L. Zickert

[57] ABSTRACT

A segmented sliding sill wear plate for universal application to fit a variety of installations and which includes a metal base plate having a plurality of low friction plastic pads bonded to the plate in spaced apart relation, wherein a single long wear plate with multiple pads can be made without warping and can thereafter be cut to size and suitably secured to a sliding sill support member such as by welding or by fastening devices. Because of the size of the plastic pad, a wear plate cut to size can withstand a wide range of temperatures without causing delamination of the plastic material or warping of the metal base.

10 Claims, 2 Drawing Sheets

SEGMENTED SLIDING SILL WEAR PLATE

This invention relates in general to a wear plate for a sliding sill on a railway car or an extendable chassis on a highway trailer, and more particularly to a segmented wear plate capable of being cut to size so as to fit any number of installations, and still more particularly to a wear plate having a plurality of spaced plastic pads bonded to a metal base member which can withstand a wide range of temperatures without failure.

BACKGROUND OF THE INVENTION

It has been well known to provide plastic wear members for railway vehicles. For example, U.S. Pat. Nos. 4,188,888; 4,237,792 and 4,289,077 show wear members in the form of liners for center bearings of trucks. Wear members of plastic have also been widely used at the sliding surfaces of coupler members, as disclosed in U.S. Pat. Nos. 4,238,039; 4,249,665; 4,261,472, and 4,264,015. Plastic wear members have further been used for pedestals of a railway truck, as disclosed in U.S. Pat. Nos. 4,237,793 and 4,239,007; and for brake rods, as disclosed in U.S. Pat. Nos. 4,079,818 and 4,452,345.

Heretofore, it has been known to provide a wear plate of plastic material for a sliding sill support, as disclosed in U.S. Pat. No. 4,348,964. This wear plate is made of a resilient material having a low coefficient of friction and is formed to fit on a specific sized support member. Accordingly, for different installations another size wear plate member must be used.

It has also been known to provide custom-made wear plates which include plastic pads bonded to steel base plates wherein the base plate is mounted to a sliding sill support by welding the base plate in place. Since it is custom made, it requires the stocking of a number of different wear plates in order to service various applications. Further, the plastic body in some versions is of such a length that during the bonding operation the metal base plate may become warped or have a "banana effect". Additionally, where the plastic pad is of a rather long length, it tends to delaminate in extremely cold or hot weather because the coefficient of expansion of the plastic material is much higher than that of the metal base plate. Plastic usually has a coefficient of expansion of about ten times greater than steel.

Heretofore, where various sizes of wear plates were needed to handle all installations, multiple molds were required for molding the plastic pads as the wear plates were customized. Further, where long wear plates were required and only a weld allowed at each end, the wear plate would be subjected to the "oil can" or buckling effect when undergoing severe temperature shifts because of the differential in the coefficient of expansion of the plastic material and the metal base. This "oil can" effect will eventually crack the welds and the wear plates will fall out.

It was also known to use large sheets of plastic for certain installations that measured four feet by eight or ten feet and which had to be secured in place by mechanical fasteners which necessitated providing slotted holes in the plastic to allow for expansion and contraction.

These wear members have been developed following the availability of suitable plastic resins and particularly certain polyethylenes, such as a linear high-density polyethylene which is usually referred to as an ultra-high molecular weight polyethylene. As disclosed in some of the above patents, these plastic materials have been bonded to metal supporting members which are then mounted on supporting parts of a railway vehicle, or used in sheets and secured in place.

SUMMARY OF THE INVENTION

The present invention is directed to an improved wear plate for a sliding sill assembly of a railway car or for an extendable chassis of a highway trailer boggie system that is adjustable to various lengths. The invention obviates the difficulties encountered by heretofore known sliding sill wear plates or boggie system wear plates having plastic material of a low friction self-lubricating type for slidably supporting a steel sliding sill plate. The wear plate of the invention includes a segmented plastic pad enabling it to withstand a wide range of temperatures and permitting it to be cut to fit various sliding sill assemblies. More particularly, the wear plate includes a metal base plate having a plurality of plastic pads molded and bonded to the plate. An open area is provided on the base plate along at least one side of the pads and therebetween which facilitates fastening the wear plate to a stationary member. When the base plate is steel, it may be easily welded to a stationary support of steel, and when of aluminum, it may be bolted, screwed or otherwise fastened in place. Moreover, a steel base plate could be bolted or otherwise fastened to a support of aluminum or other material. It can be adapted to be used not only on end carriers but also on center plates by merely cutting the plate to size at the installation site. It can be similarly adapted for use on trailers. So, the present invention provides one size wear plate for all car designs. It may be used for Z sill assemblies or H sill assemblies or even tubular assemblies. The present invention in one form is universal to fit nearly all installations which reduces inventory, reduces paperwork in the ordering of parts, minimizes handling and stocking of spare parts, and saves space in the warehouse or storage area.

The wear plate of the invention comprises an elongated metal base plate having a plurality of equally spaced apart pads of self-lubricating, high compressive strength plastic material molded directly to the base plate. The pads are of the same size and usually thicker than the metal base plate. By having a plurality of pads as opposed to a single pad on a base plate, the pads can be made thicker to last longer, and the problem of warping during manufacture is eliminated. Thus, the wear plate of the invention has longer life than previous wear plates.

Where larger areas of wear protection is desired, the present invention is especially useful with the segmented pad construction, as it has previously been impossible to construct a wear plate with a large plastic pad because of the differential in coefficients of expansion of the plastic and the metal base plate. A wear plate according to the present invention can be safely welded or bolted directly in place. Further, the segmented wear plate of the invention substantially reduces the breakaway force needed to initiate movement of a sliding member in contact with the plastic and which is generated by friction and the pressure of the sliding member on the stationary wear pad. Thus, the present invention produces smoother and more efficient operation.

The present invention eliminates the need for multiple molds to make wear plates for different installations, thereby minimizing the cost of the ultimate product. Only a single mold is needed to make one initial size.

Further, because the wear plate of the invention is segmental, that is, where a plurality of plastic pads are bonded along the metal base plate, the base plate can be stitch-welded between the pads to the sliding sill support member. Because extreme cold or hot weather conditions would cause delamination of the pads at the ends in heretofore plastic pads bonded to metal, it was necessary to use thinner pads to overcome that problem. Here it should be appreciated that the wear plates must be capable of withstanding temperatures of minus 45 degrees F. to plus 150 degrees F. The present invention solves this problem.

The present invention allows segmenting of the pads on an even larger base plate and which eliminates the "banana effect" that would be present if the pad was solid across the entire base plate.

It is therefore an object of the present invention to provide a new and improved wear plate for sliding sill or boggie installations which includes a metal base member having segmented plastic pads bonded thereto which eliminates warping problems in the manufacturing process and during storage.

Another object of the present invention is in the provision of a new and improved wear plate for sliding sill or boggie assemblies which includes an elongated metal base plate and a segmented plastic layer bonded to the metal base plate which defines a single universal wear plate that may be cut to size to fit substantially all of the sliding sill or boggie assembly designs in use today.

A further object of the present invention is in the provision of a segmented wear plate including a metal base plate with segmented plastic material bonded thereto which eliminates the delamination of the plastic material during extremely cold or hot temperatures as internal stresses are all but eliminated and which allows the use of a thicker plastic pad that can withstand colder and hotter temperatures and which will wear substantially longer.

A further object of the present invention is to provide a wear plate having a metal base and a segmented plastic pad or a plurality of spaced pads wherein the life of the wear plate is greatly extended because the wear plate is self-cleaning and thereby reduces the opportunity of metal debris or foreign material embedding in the plastic body as it will drop into spaces between pads.

A still further object of the invention is in the provision of a wear plate having a segmented plastic pad that permits one size to fit substantially all applications and which eliminates stresses normally encountered and eliminates the need for multiple molds for different installations.

Another object of the present invention is to substantially reduce the breakaway force of a sliding member in contact with the wear plate.

Other objects, features and advantages of the invention will be apparent from the following detailed disclosure, taken in conjunction with the accompanying sheets of drawings, wherein like reference numerals refer to like parts.

DESCRIPTION OF THE INVENTION

Figure 1:
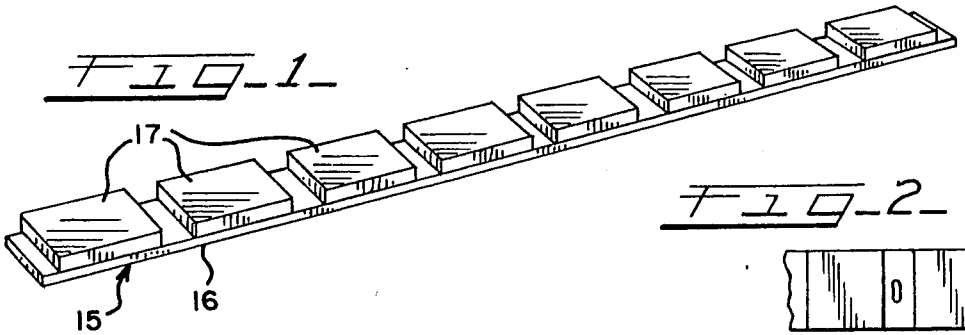
FIG. 1 is a perspective view of the segmented wear plate of the invention.

Referring now to the drawings, and particularly to FIG. 1, the segmented wear plate of the invention, generally designated by the numeral 15, includes an elongated metal base plate 16 having a plurality of spaced apart pads of plastic material 17 bonded to the base plate.

It will be apparent that the wear plate can be cut to size for a particular installation as illustrated in exemplary uses of the wear plate. In this respect, the embodiment shown in FIG. 1 has a universal application for many installations thereby avoiding the need to have special custom-made wear plates for each installation. It will be appreciated that in railway car repair yards, or a highway trailer repair facility, the availability of tools for cutting the wear plate into suitably sized sections and for welding the wear plate onto support members for sliding sills are usually available. This enables the repair person to quickly and easily adapt the wear plates of the present invention for a particular installation. It reduces inventory and eliminates costly "holding" of a car for repair if one required size is out of stock.

The metal base plate will usually be made of a suitable steel, as it usually will be welded to a sliding sill support base of steel in most installations. However, the base plate could be made of aluminum or other metals if desired, and it could be otherwise secured to the support base such as by use of any suitable fastening means, such as bolts or screws.

The plastic pads 17 are molded and bonded to the base plate 16 in a well known manner. Thus, the pads are essentially simultaneously molded and bonded to the base plate which has been prepared in a suitable manner prior to molding.

While any suitable plastic material having a low coefficient of friction to steel, a high compressive strength and a high resistance to wear may be used, it will be appreciated that the plastic material preferably be a linear high-density polyethylene which is usually referred to as an ultra-high molecular weight polyethylene. One such acceptable polymer material is defined as "1900 UMHW polymer" and available from Himont U.S.A. This material has a molecular weight greater than three million. It is also preferable that the plastic be black in color, as black has the highest resistance to ultra-violet and also because black has the most suitable heat coefficient which reduces cycle time during the manufacturing process that requires heat and pressure. However, the plastic may be of any color desired and may be of other types such as nylon and the like. This plastic resin is also dry self-lubricating so as to minimize wear on any surface it engages.

While the wear plate may be made of any suitable length and size, it has been determined that a length and size that will satisfy the largest number of installations on railway cars for both center plates and end carriers or for highway trailer boggies as well as tubular sliding sills will be accommodated, for example, by a wear plate of forty inches in length and three inches wide. Further, the thickness of the steel base plate may be one-eighth inch, while the thickness of the plastic pad may be one-quarter inch or more if desired. Each plastic pad is spaced apart one inch and is of four inches in length and the same width as the base plate, and a one-half inch clearance is left at each end of the entire wear plate for welding or for a bolt hole. Thus, when one installation would require a wear plate length of a length that would include two plastic pads, the metal plate can be cut between the second and third plastic pads and still leave one-half inch clearance of base plate for the portion cut from the entire plate and for the remainder of the wear plate. The length cut from the entire wear plate depends on the installation needs. Where an installation requires the entire forty-inch wear plate, it can be used intact. It may be appreciated the dimension of the wear plate and size and number of plastic pads may vary as long as the pads are sized to be moldable onto the base plate and not adversely affect the base plate shape and to withstand extremely cold and hot temperatures without delaminating. Further, they need not extend the full width of the base plate as shown.

The coefficient of expansion of the plastic material for the pads is substantially higher than the metal base plate. Because the plastic pads are molded to the metal base plate, they must be at a molding temperature which raises the temperature of the base plate. Heretofore, it has not been possible to make a forty-inch long wear plate with a solid plastic pad because of the differential in coefficients of expansion which will usually produce a "banana effect" or warping during the manufacture or in storage prior to use when subjected to extreme hot or cold temperatures.

Previously known wear plates having a continuous plastic pad from end to end on a metal base plate have failed because of plastic pad delamination at the ends when the wear plate is subjected to low or high temperatures. Moreover, such continuous pads have a high breakaway force. In order to prevent failure, the wear plates must be capable of withstanding temperatures of minus 45 degrees F. to plus 150 degrees F. Heretofore, in order to avoid delamination at extreme cold and hot temperatures, it was necessary to limit the thickness and length and width of the plastic pad, thereby sacrificing wear life. This thickness can be increased in the present invention, thereby extending the life of the wear plate. The shorter segmented pads virtually eliminate the problem caused by the differential in coefficients of expansion, so, segmenting the plastic pads will overcome this major problem heretofore existing.

Figure 2:
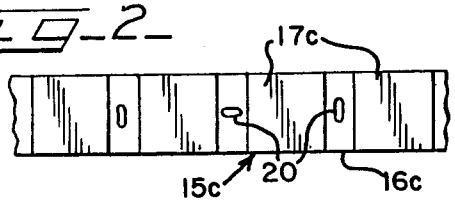
FIG. 2 is a fragmentary top plan view of a modified wear plate where openings are provided in the base plate between plastic pads.

Further, inasmuch as the wear plate of the present invention is segmented, when using a plurality of pads, the metal base plate may also be tack or stitch-welded to the sill support in the areas between the plastic pads in addition to merely providing weldments at the opposite ends of the pads. With respect to the embodiment of FIG. 1, stitch-welding could be effected between the metal base plate and the sill support at the opposite edges of the metal base plate in the areas between adjacent plastic pads. Alternatively, openings or holes may be formed in the metal base plate at the areas between adjacent pads as illustrated in the embodiment 15C of FIG. 2 where openings 20 are formed in the base plate **16*c* in the areas between the plastic pads 17*c***. A plug weld may be applied then to the opening for welding that portion of the base plate directly to the sill support. Further, the holes may serve to accommodate bolts or screws where the wear plate may be bolted or screwed to a support, thereby making them easily replaceable. It will be appreciated that the openings would not be of a size that would in any way structurally weaken the base plate to a point that would adversely affect the structural integrity of the base plate. This positive method of attaching the base plate eliminates "oil-canning" which will eventually crack the welds.

Figure 3:
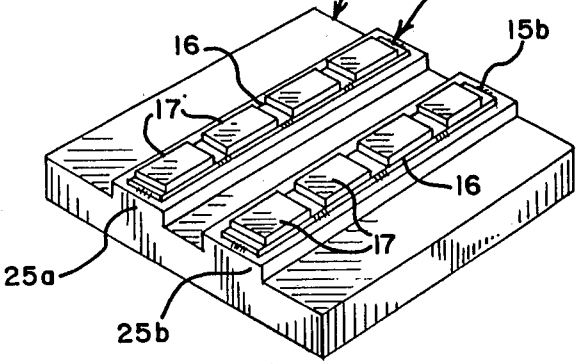
FIG. 3 is a perspective view of a support member for a center plate having a wear plate of the present invention mounted thereon and illustrating that it can be sized to fit a particular installation.
Figure 5:
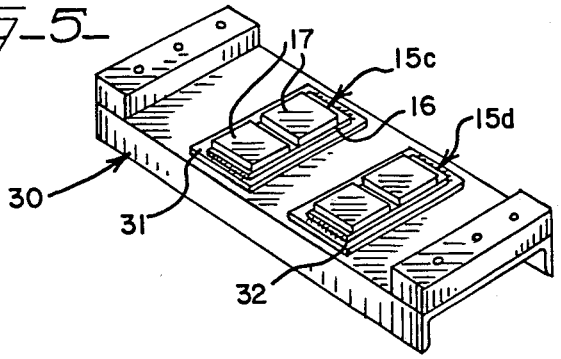
FIG. 5 is a perspective view of an end carrier for a railway car having a wear plate of the present invention differently sized from the one in FIG. 3 by merely cutting down the length of the wear plate.

The plastic pads 17 on the wear plate have a length such that at least two of the pads would be used in every installation such as shown in FIG. 5, while four plastic pads are shown in the installation in FIG. 3. Plural plastic pads function to enhance the self-cleaning of the sliding sills in that the spacing between adjacent plastic pads allows a collection of foreign matter. The pads would be arranged so that the sill slides along aligned pads and across the open spaces. This self-cleaning action further enhances the life of the wear pad, as does the elimination of delamination at temperature extremes.

Figure 4:
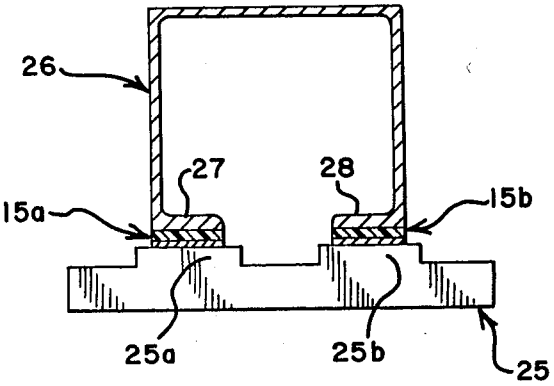
FIG. 4 is a vertical cross-sectional view taken through a sliding sill end support member having the wear plate of the invention and of the installation shown in FIG. 3.

FIGS. 3 and 4 illustrate the present invention in use on a center plate 25 where the wear plate 15 would be cut in half to provide sections **15*a* and 15*b*, each of which can be then welded onto raised sliding sill support portions 25*a* and 25*b*. It will be noted that the base plate of these sections of wear plate are not only welded to the sill supports at opposite ends but also stitch or tack-welded along the sides of the metal base plate in the areas between the plastic pads. A sliding sill 26 having inwardly extending lower flanges 27 and 28 would rest on and be in slidable engagement with the wear plate and particularly the plastic pads 17. Sill 26** is generally referred to as an H-shaped sill.

Figure 6:
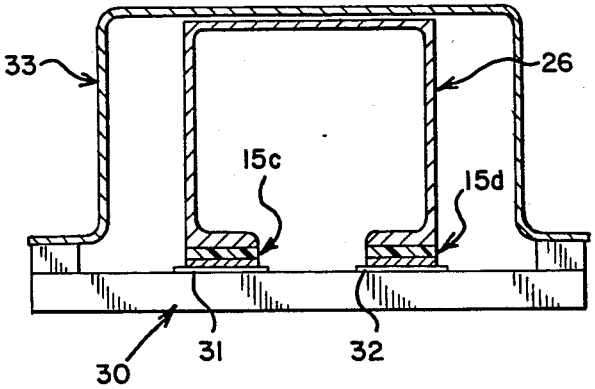
FIG. 6 is a vertical sectional view taken through a sliding sill assembly illustrating an H-shaped sliding sill and the wear plate of the invention mounted on the sliding sill support and supporting the sliding sill.

Another illustration of the use of the wear plate of the invention is illustrated in FIGS. 5 and 6 where the wear plate is cut into sections, each of which includes a pair of plastic pads 17 and are generally designated as **15*c* and 15*d* and which are mounted on an end carrier 30. More particularly, the wear plate sections 15*c* and 15*d* are suitably welded to raised sill support portions 31 and 32. This end carrier would likewise be used with a sliding sill of the H shape and therefore on the same car having a center plate 25, as shown in FIG. 3. The arrangement of the sliding sill on the wear plate sections is illustrated in FIG. 6. This also shows a fixed sill 33 supported on and fixed to the end carrier 30**.

Figure 9:
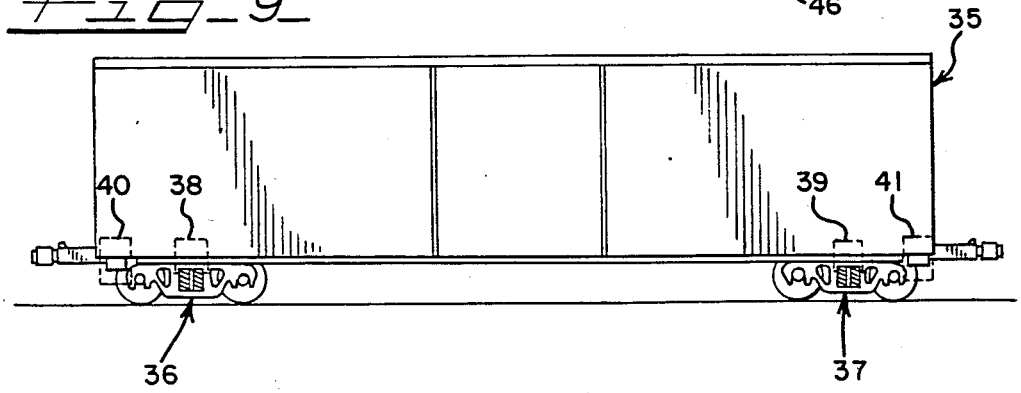
FIG. 9 is a side elevational view of a railway car and showing where wear plates would be located in connection with use on end carriers and center plates.

With reference to FIG. 9, a railway car 35 is illustrated having trucks 36 and 37. The locations of the center plates and end carriers are shown schematically. A center plate location 38 is shown in relation to truck 36, while center plate location 39 is shown with respect to truck 37. At the end of the car adjacent the truck 36, an end carrier location 40 is shown, while at the opposite end of the car an end carrier location 41 is shown. It will be appreciated that the center plates and end carriers are connected to the framework of the railway cars and are therefore stationary where the sliding sill extends the entire length of the car and is connected to the couplers, and therefore slides on the center plates and end carriers when caused to do so by routine impacts through the couplers. Additionally, it will be appreciated that the sliding sills would have cushioning devices adjacent to the center portions in order to absorb the shock of the impacts.

Figure 7:
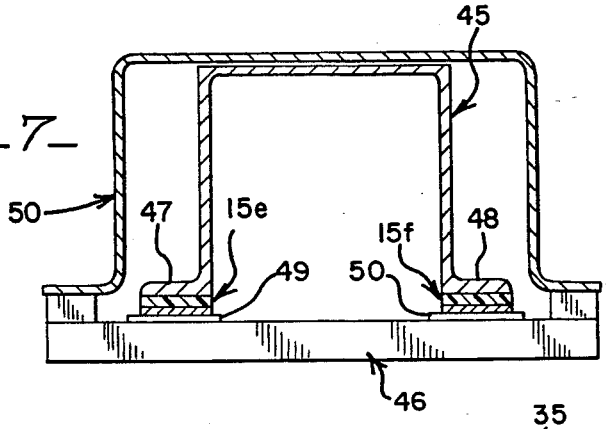
FIG. 7 illustrates the use of the present invention in a sliding sill assembly utilizing a Z-shaped sliding sill.

The use of the wear plate of the invention is illustrated in connection with a Z-shaped sliding sill 45 on an end carrier 46 in FIG. 7. Sill support flanges 47 and 48 extend outwardly and then slidably rest on wear plate sections 15*e* and 15*f* that are in turn suitably welded to raised sill support portions 49 and 50. The end carrier 46 is connected to the car framework and is also provided with a fixed sill 50 that is also connected to the car.

Figure 8:
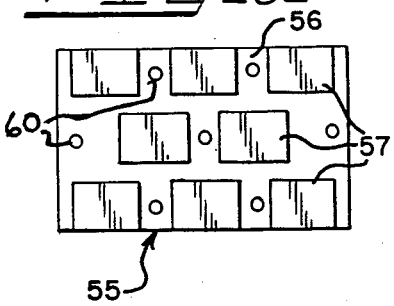
FIG. 8 is a to plan view of another modification of the invention illustrating segmenting the plastic pad on a wider base.

It should also be recognized that the segmented wear plate may be used on railway cars or trailers having tubular sills or extensions. Then the base plate and pads may be shaped to appropriately mate with a tubular member.

Where it would be necessary to have a rather large base plate such as one four feet square or larger, the plastic pads could then be molded and bonded to the base plate in a checkerboard fashion, as illustrated by the embodiment 55 in FIG. 8. This embodiment shows a base plate 56 having a plurality of plastic pads 57 molded and bonded thereto and arranged in a general checkerboard effect. Holes 58 are provided in the base plate open areas for welding or bolting. Again, by segmenting the pads, warping or the "banana effect" would be eliminated during manufacture of the wear plate or storage in cold or hot weather. Further, delamination would be eliminated during extremely cold or hot weather conditions as internal stresses in the pads are nearly eliminated.

While the wear plate is shown to be secured to fixed members, such as end carriers and center plates, it may be appreciated that the wear plate may be secured to a movable member instead of a fixed member.

From the foregoing, it may be appreciated that the wear plate of the present invention has a substantially longer life than heretofore known wear plates and is of a configuration that can easily be sized to fit a number of installations. Thus, it is of a universal size to accommodate use on end carriers as well as center plates or other areas. It is also self-cleaning to enhance life.

It will be understood that modifications and variations may be effected without departing from the scope of the novel concepts of the present invention, but it is understood that this application is to be limited only by the scope of the appended claims.

The invention is hereby claimed as follows:

1. In a sliding sill support assembly for a railway car or a highway trailer boggie slider system, including a longitudinally arranged sill support means for slidably supporting a sliding sill, and wear plate means mounted on said sill support means, the improvement in said wear plate means which comprises an elongated flat metal base adapted to be bolted or welded to said sill support means, and a plurality of spaced pads of self-lubricating, high compressive strength plastic material bonded to said plate, said pads having coplanar wear surfaces, said plastic material having a coefficient of expansion higher than said base, and said pads sized to substantially eliminate high internal stresses which causes bowing of said wear plate when subjected to a wide range of ambient temperatures as experienced in normal operation.

2. The wear plate means of claim 1, wherein said plastic material is an ultra-high molecular weight polyethylene.

3. The wear plate means of claim 1, wherein said plastic material is a linear high density polyethylene.

4. The wear plate means of claim 2, wherein said plastic material is black.

5. A low friction sliding sill support assembly comprising: a fixed sill including a pair of sliding sill support members, a sliding sill normally slidable on said sill support members, a wear plate mounted on each said sliding sill support member, said wear plate comprising a flat metal base plate securable to said sill support member and a segmented plastic pad molded and bonded to said metal base plate and in slidable engagement with said sliding sill, said pad being of a material that is self-lubricating and of high-compressive strength and having a plurality of segments in spaced apart relation and longitudinally aligned with said sill, whereby the pad is self-cleaning, and said segments having coplanar wear surfaces.

6. The assembly of claim 5, wherein the pad terminates short of each end of the base plate and is weldable to the sill support member at the ends or the sides between the segments.

7. The assembly of claim 5, wherein the pad terminates short of each end of the base plate and is boltable to the sill support member at the ends or the sides between the segments.

8. The assembly of claim 6, wherein the pad extends to the opposite sides of the base plate and the segments are of a size that eliminates warping of the base plate during molding of the pad onto the base plate and when subjected to extreme cold and hot temperatures in service.

9. The assembly of claim 5, wherein openings are provided in the base plate between segments for plug welding or bolting the base plate to the sill support member.

10. In an assembly including a stationary member and a movable member slidably supported on said stationary member and a wear plate means between the members, the improvement in said wear plate means which comprises, a metal base plate, a plurality of spaced pads of self-lubricating, high compressive strength plastic material molded and bonded to said plate, said plastic material having a substantially higher coefficient of expansion than said metal base plate, means securing said base plate to said stationary member such that the plastic pads contact the movable member, wherein the pads are arranged on the base plate in a checkerboard fashion to allow open areas along the base plate for fastening the wear plate to the stationary member, and said pads sized to substantially eliminate internal stresses when subjected to a wide range of temperature conditions experienced in normal operation to thereby prevent bowing of said wear plate and delamination of said plastic pads.

* * * * *